US006558055B1

(12) United States Patent
Shishido et al.

(10) Patent No.: US 6,558,055 B1
(45) Date of Patent: May 6, 2003

(54) PRINTER

(75) Inventors: Mitsuharu Shishido, Fuchu (JP); Yuji Nakagaki, Matsudo (JP)

(73) Assignee: Seiko Precision Inc., Chiba-ken (JP)

( * ) Notice: Subject to any disclaimer, the term of this patent is extended or adjusted under 35 U.S.C. 154(b) by 0 days.

(21) Appl. No.: 09/604,617

(22) Filed: Jun. 27, 2000

(30) Foreign Application Priority Data

Jun. 28, 1999 (JP) ..... 11-181762

(51) Int. Cl.[7] ..... B41J 33/32; B41J 11/50; B41J 11/27

(52) U.S. Cl. ..... 400/248; 400/605; 400/613.1

(58) Field of Search ..... 400/47, 26, 144.2, 400/605, 613.1, 707.1, 708; 346/1.1, 76

(56) References Cited

U.S. PATENT DOCUMENTS

| | | | | |
|---|---|---|---|---|
| 4,637,598 A | | 1/1987 | Bouwens et al. | |
| 4,856,923 A | * | 8/1989 | Smith | 400/247 |
| 4,924,240 A | * | 5/1990 | Herbert et al. | 346/1.1 |
| 5,015,107 A | * | 5/1991 | Harada et al. | 400/144.2 |
| 5,266,967 A | * | 11/1993 | Maslanka | 346/76 |
| 6,155,728 A | * | 12/2000 | Sakaino et al. | 400/26 |

FOREIGN PATENT DOCUMENTS

| | | |
|---|---|---|
| EP | 19179-045/we | 10/2000 |
| JP | 58-089542 | 5/1983 |
| JP | 60-039580 | 3/1985 |
| JP | 63-104864 | 5/1988 |
| JP | 4-191235 | 7/1992 |

* cited by examiner

*Primary Examiner*—Ren Yan
*Assistant Examiner*—Marvin P. Crenshaw
(74) *Attorney, Agent, or Firm*—Schulte Roth & Zabel

(57) ABSTRACT

The present invention is directed toward a printer having a ribbon guide capable of reflecting light emitted from a paper detection sensor away from the paper detection sensor in the absence of a printing paper. As a result, the possibility of erroneous recognition of paper detection is eliminated. There are provided a print head 1, a ribbon guide 3 attached to the print head, and a reflection-type paper detection sensor 4 arranged on a side of the platen in a manner opposed to a printing paper P passing between the platen and the ribbon guide 3 to emit light for detecting the printing paper. The ribbon guide 3 is formed with sloped surfaces 3*b* and 3*d* that are inclined relative to a surface of a printing paper P to reflect the light emitted from the paper detection sensor 4 toward a position away from the paper detection sensor.

10 Claims, 1 Drawing Sheet

PRINTER

BACKGROUND OF THE INVENTION

1. Field of the Invention

The present invention relates particularly to a printer for positively detecting a presence or absence of printing paper fed in a printing portion of the printer.

2. Description of the Related Art

The conventional printer, as shown in FIG. 1, has a printing portion with a print head a and platen b which are oppositely arranged so that a printing paper P may be sandwiched there between. A ribbon guide c is attached to the print head a for guiding an ink ribbon R. On the platen b side of the printer, reflection-type paper detection sensors d are provided and arranged in a manner opposed to a printing paper P passing between the platen k and the ribbon guide c. The reflection-type paper detection sensors d are used to detect the presence or absence of the printing paper P. To accurately detect a presence or absence of a printing paper P, it is preferred that the paper detection sensors d are arranged as close as possible to a printing position. Accordingly, the paper detection sensors d are arranged in a position opposed to the ribbon guide c. When a printing paper P is not present, the light reflected on the ribbon guide c is received by the paper detection sensor d. To avoid erroneous detection of a printing paper P, the ribbon guide c is commonly manufactured with a black synthetic resin to minimize light reflection.

The conventional printer described above presents several problems which the present invention seeks to overcome. For example, the ribbon guide c is limited in color to black for minimization of light reflection. Also, the ribbon guide c comes in slide contact with the printing paper P. Accordingly, the ribbon guide c must be made of material that is highly resistant to wear. Thus, there has been a problem that the materials from which ribbon guide c may be made is quite limited. Furthermore, because the ribbon guide c is attached to the print head a as a heating member, it is desirable that the ribbon guide be made of a metal having a high heat dissipation effect. However, metal is highly reflective and will cause an intense reflection of light when a printing paper P is not present. The reflected light is received by the paper detection sensor d, thereby causing the printer to malfunction and to become unusable.

SUMMARY OF THE INVENTION

To solve the problems discussed above, the present invention implements a ribbon guide having a shape with sloped surfaces capable of reflecting the light emitted from a paper detection sensor to a position located away from the paper detection sensor in the absence of a printing paper. The ribbon guide is provided on a head block and has a sloped surface that is inclined relative to the surface of the printing paper.

When printing paper is not present between the paper detecting sensor and the ribbon guide, the light emitted from the paper detecting sensor is reflected off the sloped surface of the ribbon guide and is deflected to a position away from the paper detection sensor. As a result, the printer will not malfunction since the reflected light is not received by the paper detection sensor.

It is an object of the present invention to implement a ribbon guide for a printer having sloped surfaces which deflect light away from paper detection sensors when printing paper is not present.

It is another object of the present invention to implement a ribbon guide for a printer that may be made of desirable metals.

Other objects will become apparent from the foregoing description.

The present invention is directed toward a printer having a ribbon guide formed with a sloped surface that is inclined relative to a surface on which printing paper is fed. Accordingly, when a printing paper is not present between the paper detection sensor and the ribbon guide of the present invention, the light emitted from the paper detection sensor reflects off of these sloped surfaces toward a position away from the paper detection sensor. In essence, the present invention relies on the state of inclination of the sloped surface without relying upon a state of a surface of the ribbon guide. As a result, the present invention eliminates the possibility of erroneously detecting the presence or absence of printing paper, thus enabling stable detection of a printing paper. Because the ribbon guide's surface state is not relied upon, various materials can be selected and used as a ribbon guide. The ribbon guide is preferably made of a metal. The use of a material high in thermal conductivity, such as aluminum enhances the effect of heat dissipation of the print head. Alternatively, the ribbon guide may be made of a material high in rigidity, such as magnesium. Highly rigid materials are desirable because the print head is driven together with the ribbon guide in a direction approaching the platen to urge the ribbon guide on a surface of a printing paper. The use of highly rigid materials will decrease the amount of deflection of the ribbon guide during the measurement of the paper thickness of a printing paper.

DESCRIPTION OF THE PREFERRED EMBODIMENTS

Figure 1:
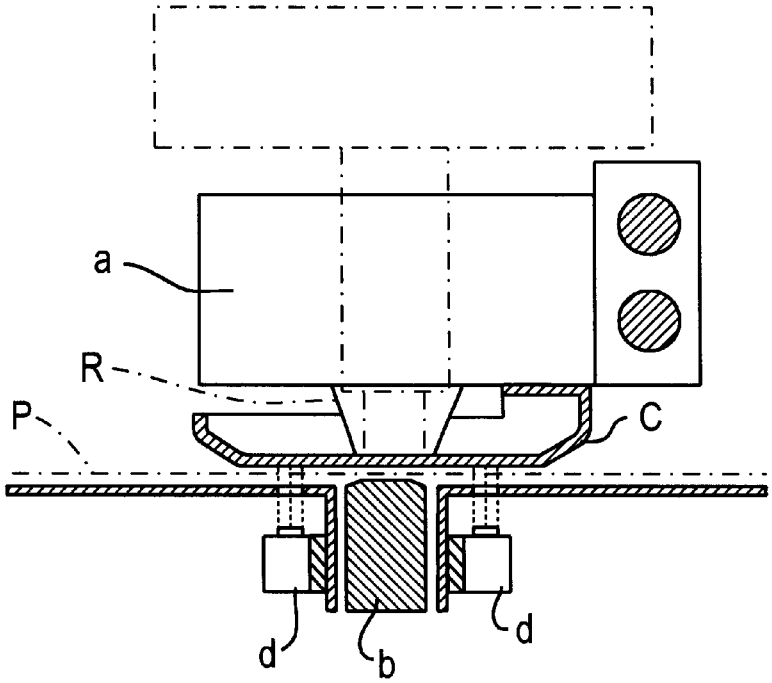
FIG. 1 PRIOR ART
FIG. 1 is a sectional view of a Prior Art printer having a ribbon guide that is parallel to the platen of the printer.
Figure 2:
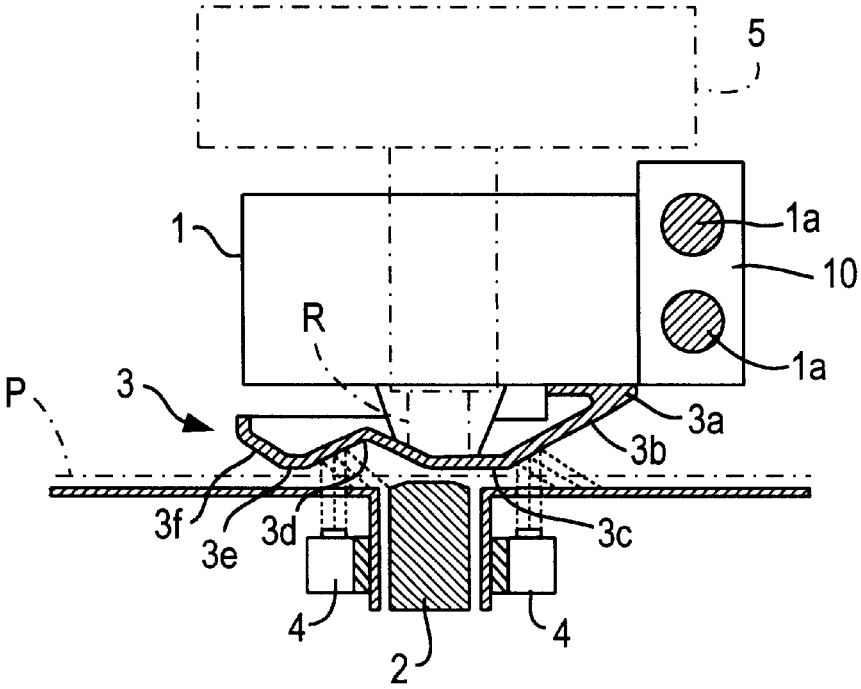
FIG. 2 is a sectional view of the printer of the present invention having a ribbon guide with sloped portions capable of deflecting light away from the light sensors of the printer when printing paper is not present.

An example of one embodiment of the present invention is described below with reference to FIG. 2.

In a printing portion of a printer, a print head 1 and a platen 2 are arranged opposite to each other with a predetermined spacing provided so that a printing paper P may be fed between them. The print head 1 is mounted on a carrier 10 so that it is guided on guide shafts 1*a*. The carrier 10 moves print head 1 parallel with the platen 2 in a direction orthogonal (rectangular direction of the page in FIG. 2) to the direction in which the printing paper P is fed (right-left direction in FIG. 2). The platen 2 extends in a direction orthogonal to the direction in which the printing paper P is fed such that it is opposed to the printing head 1 at all times regardless of movement of the printing head 1. A ribbon guide 3 is attached to the print head 1 as described in detail herein below. The printing paper P is fed between the ribbon guide 3 and the platen 2. Collectively, the ribbon guide 3, print head 1 and carrier 10, constitute a head block. The printing paper P is selectively fed between the print head 1 and the platen 2 from upstream or downstream of the print head 1. Reflective-type paper detection sensors 4 are arranged on the platen 2 side of the printer so that they are in a position opposite to the ribbon guide 3. The reflective-type paper detection sensors 4 are used to detect a presence or absence of a printing paper P passing between the ribbon guide 3 and the platen 2. The paper detection sensors 4 are used for detecting a beginning end and a terminating end of a printing paper P. The detection sensors 4 are provided on opposite sides of the platen 2 to detect printing paper P being fed from both upstream and downstream of the print head 1.

The shape of the ribbon guide 3 is now described below. The ribbon guide 3 has a print-head mount 3*a* at one end which has a sloped surface 3*b* extending downwardly from the mount 3*a* to a position close to platen 2. At this point, the ribbon guide 3 is bent so that its surface 3*c* is parallel with a top surface of the platen 2, i.e., parallel with a surface of a printing paper P passing between the ribbon guide 3 and the platen 2. The guide surface 3*c* has an end which is bent so that it slopes upwardly toward surface 3*d* of the ribbon guide 3. Surface 3*d* slopes downwardly toward end 3*e* of the ribbon guide 3. End 3*e* is set in a position flush with the guide surface 3*c*. End 3*e* is bent upwardly toward end 3*f* of the ribbon guide 3.

The sloped surfaces 3*b* and 3*d* are formed in positions where light emitted from the paper detection sensor 4 is illuminated. The sloped surfaces 3*b* and 3*d* are on an incline relative to a surface of a printing paper P passing between the ribbon guide 3 and the platen 2. As a result, when a printing paper P is present between the ribbon guide 3 and the paper detection sensors 4, the light emitted from the paper detection sensors 4 reflects upon the printing paper P and the reflected light is received by the paper detection sensors 4. However, when a printing paper P is not present between the ribbon guide 3 and the paper detection sensor 4, the light is reflected upon the sloped surfaces 3*b* and 3*d* and is deflected toward positions away from the paper detection sensors 4. Thus, the light from the detection sensors 4 will not be received by the paper detection sensor 4.

A ribbon cassette 5 is arranged above the print head 1. An ink ribbon R is drawn out of the ribbon cassette 5 and is guided by the ribbon guide 3 such that it is opposed to a printing paper P being fed between the print head 1 and the platen 2. Accordingly, the ink ribbon R passes through the gap between the print head 1 and the platen 2 and is guided on a plane parallel to the top surface of the platen 2 and surfaces 3*c* and 3*e* of the ribbon guide 3.

When a printing paper P is fed between print head 1 and platen 2 so that its beginning end reaches a position between the ribbon guide 3 and the paper detection sensor 4 (e.g., during paper feed), the light emitted from the paper detection sensor 4 reflects upon a surface of the printing paper P. The reflected light is returned to and received by the paper detection sensor 4. As a result, the detections sensor 4 detects the existence of the printing paper P. On the other hand, when the printing paper P is not present between the ribbon guide 3 and the paper detection sensor 4 (e.g., during print operation), the light emitted from the paper detection sensor 4 is illuminated to the sloped surface 3*b* or 3*d* of the ribbon guide 3 and reflected toward positions away from paper detection sensor 4. Since the reflected light is not received by the paper detection sensor 4, the paper detection sensor 4 is positively able to detect an absence of printing paper P. The paper detection relates only to the sloped surfaces 3*b* and 3*d* of the ribbon guide 3 without being affected by a surface state of the ribbon guide 3. Accordingly, the ribbon guide 3 may freely be made of desirable materials.

Preferably, the ribbon guide 3 is made of a metal high in reflectivity and excellent in thermal conductivity. The print head 1 is a heating member and the printing portion is heated to high heat. The ribbon guide 3 may be made of a metal having a high thermal conductivity, such as aluminum, to enhance the effect of cooling of the print head 1 so that the print speed is improved. Alternatively, the ribbon guide 3 may be made of a highly rigid metal, such as magnesium. In this case, the print head 1 is driven, together with the ribbon guide 3, in a direction approaching the platen 2 so that the ribbon guide 3 is depressed onto a surface of a printing paper P. The thickness of the printing paper P is measured and the deflection of the ribbon guide 3 is decreased during paper thickness measurement, thus improving the accuracy of paper thickness detection.

Incidentally, the ribbon guide 3 is not limited to its attachment to the printing head 1 and may be mounted on the carrier 10. Otherwise, it may be formed integrally with the print head 1 or a carrier 10.

As will be apparent to one having skill in the art, modifications can be made to the programming flow, structure, materials, and processes detailed herein without departing from the spirit and scope of the invention as defined by the appended claims.

What is claimed is:

1. A printer comprising:

a head block having a print head and a ribbon guide; a platen arranged opposed to the print head; and a reflection type paper detection sensor arranged on a side of the platen in a manner opposed to a printing medium passing between the platen and the ribbon guide to emit light for detecting a presence or absence of the printing medium; wherein the paper detection sensor is provided in a position opposed to the ribbon guide; and the ribbon guide being inclined relative to a surface of the printing medium and formed with a sloped surface to reflect light emitted from the paper detection sensor toward a position outside the paper detection sensor when the printing medium is not present between the paper detection sensor and the ribbon guide.

2. A printer according to claim 1, wherein the ribbon guide is made of a metal.

3. A printer comprising:

a head block;

a ribbon guide affixed to said head block, wherein said ribbon guide has at least one sloped surface which is inclined relative to a surface of printing medium to be printed; and paper detection sensor means, wherein said paper detection sensor means is provided in a position opposed to said ribbon guide so that light emitted from said paper detection sensor means is reflected toward a position away from the paper detection sensor when the printing medium is not present between the paper detection sensor and said ribbon guide.

4. The printer of claim 3 further comprising a print head on said head block;

a platen arranged opposed to said print head; and said paper detection sensor means is arranged on a side of the platen in a manner opposed to the printing medium passing between the platen and the ribbon guide.

5. The printer of claim 4, wherein said paper detection sensor means is a reflection type paper detection sensor capable of emitting light for detecting a presence or absence of the printing medium.

6. The printer of claim 4, wherein said ribbon guide is metal.

7. The printer of claim 6, wherein said metal is high in thermal conductivity.

8. The printer of claim 7, wherein said metal is aluminum.

9. The printer of claim 6, wherein said metal is highly rigid.

10. The printer of claim 9, wherein said metal is magnesium.

* * * * *